United States Patent [19]

Woods

[11] Patent Number: 4,905,909

[45] Date of Patent: Mar. 6, 1990

[54] FLUIDIC OSCILLATING NOZZLE

[75] Inventor: Robert L. Woods, Arlington, Tex.

[73] Assignee: Spectra Technologies, Inc., Arlington, Tex.

[21] Appl. No.: 92,186

[22] Filed: Sep. 2, 1987

[51] Int. Cl.[4] ..... B05B 1/08

[52] U.S. Cl. ..... 239/589.1; 239/11; 137/820; 137/835

[58] Field of Search ..... 137/820, 821, 826, 835; 239/589.1, 310, 727, 101

[56] References Cited

U.S. PATENT DOCUMENTS

| | | | |
|---|---|---|---|
| 3,228,410 | 1/1966 | Warren et al. | 137/821 |
| 3,423,026 | 1/1969 | Carpenter | 137/820 |
| 3,468,326 | 9/1969 | Cohen | 137/821 |
| 3,575,348 | 4/1971 | Mackay | 239/310 |
| 3,584,635 | 6/1971 | Warren | 137/821 |
| 3,719,195 | 3/1973 | Matsuda | 137/821 |
| 3,998,386 | 12/1976 | Viets et al. | 239/102 |
| 4,052,002 | 10/1977 | Stouffer et al. | 137/835 |
| 4,107,990 | 8/1978 | Rignwall | 73/194 B |
| 4,157,161 | 6/1979 | Bauer | 239/11 |
| 4,184,636 | 1/1980 | Bauer | 239/11 |
| 4,185,777 | 1/1980 | Bauer | 239/589.1 |
| 4,227,550 | 10/1980 | Bauer et al. | 137/835 |
| 4,231,519 | 11/1980 | Bauer | 239/589.1 |
| 4,277,026 | 7/1981 | Garvey | 239/727 |
| 4,463,904 | 8/1984 | Bray, Jr. | 239/590 |
| 4,526,321 | 7/1985 | Knudsen | 239/229 |

*Primary Examiner*—Andres Kashnikow
*Assistant Examiner*—Christopher G. Trainor
*Attorney, Agent, or Firm*—Saidman, Sterne, Kessler & Goldstein

[57] ABSTRACT

A fluidic oscillating nozzle that oscillates a fluid jet at high frequency by the use of fluidic amplification technology with no moving parts. The jet that issues from the nozzle is a zero-degree jet of fluid that maintains a very high energy density; however, due to its oscillation, its appearance is that of a fan-type jet that disperses at a fan angle from the nozzle. At a nominal distance from the nozzle, the jet covers the surface with a relatively broad area of flow while maintaining high energy impact density due to the impact effects of the non-expanding zero-degree jet.

8 Claims, 5 Drawing Sheets

FLUIDIC OSCILLATING NOZZLE

BACKGROUND OF THE INVENTION

1. Field of the Invention

This invention relates to nozzles that disperse a fluid or fluids to a surface for cleaning, washing, blasting, or allied processes in which fluid impact with the surface is important. In addition, these nozzles have the ability to provide a spray over a large area with a liquid droplet size larger than conventional fan-type nozzles having the same pressure and flow. Consequently, a spray over a large area with low overspray and atomization is obtained.

2. Description of Related Art

There has been long-term interest in the use of pressurized fluids to impact surfaces. An example of one such application of pressurized fluids is the use of pressurized water for cleaning and washing of cars, trucks, industrial equipment, floors, driveways, and buildings. In any cleaning operation there are three functions to be performed: (1) the application of water or water and chemicals to soak dirt and film on the surface to be cleaned (soaking function), (2) the removal of dirt and film by the impact of the water jet (removal function), and (3) the application of water for rinsing the cleaned surface (rinsing function).

For a given amount of water in a given volume, the relative relationships between water pressure, velocity, flow rate, and impact energy are proportional: the higher the pressure, the higher the velocity; the higher the velocity, the higher the flow rate; the higher the velocity and flow rate, the higher the impact energy. However, the impact energy actually generated depends on the area of the surface impacted. This relationship between the impact energy and the area to be cleaned may be termed the impact energy density. To achieve a higher impact energy density, either the velocity and flow rate must be increased or the area impacted must be decreased.

In the soaking and rinsing functions, the flow rate of water, and thus the velocity and water pressure, must be sufficiently large to apply the necessary amount of water to cover the surface to be cleaned and to do so in a given amount of time. Particularly for the rinsing function, there is a minimum flow rate that is efficient in terms of time and water usage. In addition, the water pressure must be sufficiently large to project the water to the surface to be cleaned at a high velocity so that the impact energy of the water will be sufficient to dislodge dirt and other particles to perform the removal function. For water usage to be the most economical, a balance between the flow rate and the impact energy must be achieved. This balance must also be taken into account for each of the three cleaning functions.

To produce the desired effects during the soaking and rinsing functions, it is desirable to spread the water or water and chemicals over a large area. One common means of producing a flow over a large area is by a fan-type nozzle. The fan-type nozzle uses a small opening to limit the flow rate and expand the jet over a large area. The small opening causes the jet to break up into small droplets. The velocity of these droplets decreases as they impact the air. This decreased velocity means that the fan-type jet has a low impact energy. Furthermore, because the fan-type jet is spread over a large area, the impact energy density is low.

To produce the desired effects during the removal function, it is desirable to impact the water or water and chemicals over a small area so that there is a high impact energy density. One means of producing a flow over a small area is by using a nozzle that generates a zero-degree jet. Such nozzles are well-known to the art. A zero-degree jet is a jet that does not expand radially with respect to the direction of travel as it is projected from the nozzle. Because the droplets in a zero-degree jet follow the same path, the effects of air drag are decreased and the jet retains much more of its initial velocity than does a fan-type jet. Thus, the impact energy of a zero-degree jet is larger than that of a fan-type jet for two reasons. First, in contrast to a fan-type jet, a zero-degree jet impacts a smaller area, and thus, the impact energy density of a zero-degree jet is larger than that of a fan-type jet. Second, because the aerodynamic drag affects the fan-type jet more, the fan-type jet loses its momentum more drastically as a function of distance travelled. Consequently, the zero-degree jet produces a larger impact energy and a larger impact energy density than a fan-type jet.

Another use of pressurized fluids is the application of chemicals such as insecticides and herbicides to a selected area. In these applications, it is important to direct the chemicals to the target area with a minimum of direct overspray or atomization of liquid to avoid susceptibility to drift. Consequently, in addition to requiring high pressure (for distance) and low flow, this application requires large droplet size which is inconsistent with that provided by conventional fan-type nozzle configurations.

OBJECTS AND SUMMARY OF THE INVENTION

The two requirements of high impact energy density (requiring a zero-degree jet) and the large area rinsing function (requiring a fan-type jet) are at odds with each other and would require either a fixed nozzle which would compromise performance or an adjustable nozzle which could accomplish one function at a given time. However, the two requirements can be combined in an optimum manner by oscillating a zero-degree jet.

It is one object of this invention to generate a high density zero-degree jet with high impact energy density to provide good cleaning ability and to oscillate the jet back and forth at high frequency so that the spray angle is large enough to cover a large area for effective rinsing. With the combination of these two effects of high impact energy density for effective cleaning and the oscillation of the jet for effective rinsing, the overall cleaning effectiveness can be substantially improved relative to a conventional fan-type nozzle.

It is another object of the invention to provide for both vented and unvented configurations with the choice between the two configurations being dependent on the particular application or desired use of an oscillating zero-degree jet.

It is a further object of the invention to provide for the introduction of soap or other chemicals to the oscillating jet. Both techniques for injecting upstream and downstream of the main mechanical pump are sought to enhance cleaning effectiveness. The object of the later technique is to introduce such chemicals directly into the oscillating jet to avoid damage to the pump and cavitation.

It is a another object of the invention to regulate the introduction of soap or other chemicals into the oscillating jet.

Still another object of the invention is to minimize overspray and maximize the reach of the fluid stream.

SUMMARY OF THE INVENTION

The foregoing and other objects and aspects of the present invention are achieved through the provision of a fluidic oscillating nozzle comprising a supply port connected to a primary fluid flow passage converging to a throat, a nozzle, and control means. These elements may be connected to a fluidic oscillator comprising a pressure source connected to a secondary fluid flow passage converging to a throat, nozzle means, an interaction region including inlet and outlet openings, and feedback passages originating at receivers and terminating at control ports.

The interaction region may be vented or unvented to the surrounding atmosphere. The interaction region may be connected to a venturi jet pump comprising a plenum area and fluid flow chamber comprising a converging-diverging venturi, and a suction inlet jet. A fluid flow control valve may be connected to the venturi jet pump. Cleaning chemicals or other fluids may be introduced at the suction inlet jet.

BRIEF DESCRIPTION OF THE DRAWINGS

The operational principles, techniques, advantages, uses, and other attendant features of the invention will clearly appear from the detailed description of the present invention taken together with the accompanying drawings in which.

DESCRIPTION OF PREFERRED EMBODIMENTS

The preferred embodiment of this fluidic oscillating nozzle is a two-stage system having a planar fluidic amplifier with feedback passages forming a pressure oscillator and a deflected-jet fluidic device in which the fluid stream exits as a zero-degree jet into the air. The aforementioned pressure oscillator deflects the free jet of the second stage in an oscillatory pattern. Thus, the jet issuing from the fluidic oscillating nozzle is a coherent zero-degree jet that has a high impact energy density and moves in a sweeping pattern to cover a large area. Thus, the jet has the appearance of a fan-type jet. In order to more fully understand this invention, each component part as well as the interconnections will now be explained in greater detail.

Figure 1:
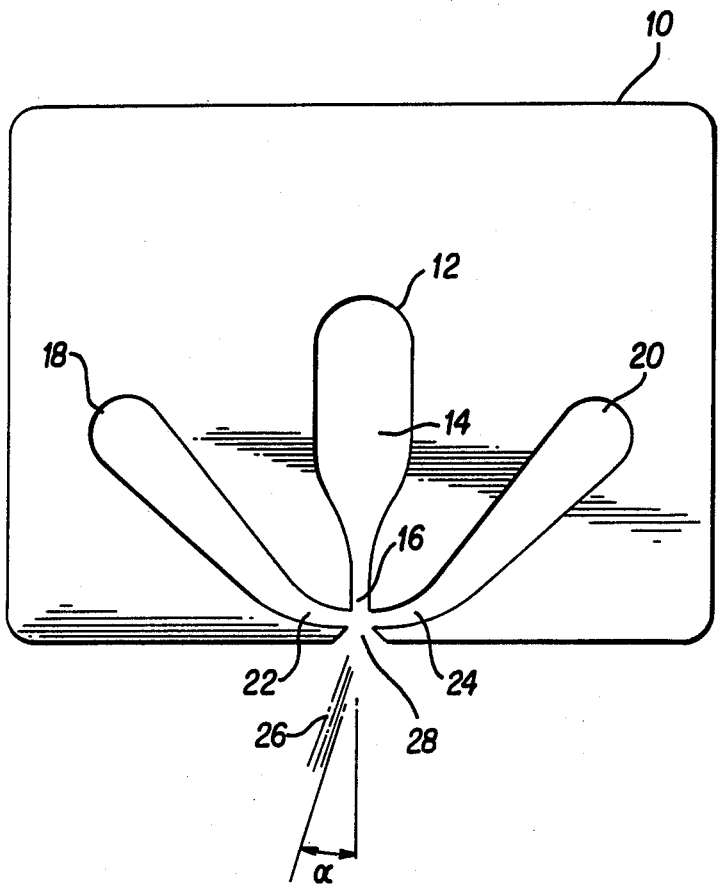
FIG. 1 illustrates a fluidic jet-deflection amplifying device.

FIG. 1 illustrates a preferred embodiment of a deflected-jet fluidic nozzle 10 which may be utilized as the second stage of the two-stage system of the present invention. Nozzle 10 has an output nozzle 28 so as to form a zero-degree jet that can be deflected in at least one plane. Nozzle 10 includes a supply port 12 that supplies water through a manifold (not shown) to the entrance of a fluid flow passage 14 that converges to form a throat 16. The fluid through port 16 constitutes what will be referred to as a power jet. Downstream from throat 16 is an output nozzle 28 from which issues an output jet 26. If the power jet in throat 16 is undisturbed, it will issue from nozzle 28 undeflected as output jet 26.

Two transverse control nozzles 22 and 24 are positioned one on either side of throat 16 to form a set of differential control jets. Nozzles 22 and 24 are supplied working fluid from control ports 18 and 20, respectively, from which are formed the differential control jets. The control jets from nozzles 22 and 24 may have momentum and pressure interactions with the power jet that issues from the throat 16 of the fluid flow passage 14. If the pressures and momenta of the control jets are equal, then the output jet 26 exits undeflected from the output nozzle 28 in substantially the same direction of travel as in the throat 16. However, applying differential fluid pressures to the control ports 18 and 20 results in control jets in control nozzles 22 and 24 having differential pressures. This pressure differential, in turn, causes output jet 26 to be deflected at an angle $\alpha$. The angle $\alpha$ of that deflection is determined by the relative magnitudes of the pressures and momenta in the power jet in throat 16 and the control jets in control nozzles 22 and 24. Because the pressure of the fluid in the supply port 12 is preferably much larger than the pressure of the fluid in the control jets in control nozzles 22 and 24, the deflection angle $\alpha$ will be acute (e.g., 15 degrees). Further, because the control jets in control nozzles 22 and 24 have relatively low momenta, the power jet velocity and flow characteristics will not be significantly disrupted.

The output jet 26 that issues from the fluidic nozzle 10 is thus a combination of the power jet and the differential control jets. This combined output jet 26 from nozzle 28 is a zero-degree jet that does not spread radially in the direction of flow into a larger flow area as does a fan-type jet. The angle of deflection $\alpha$ forms the basis for the apparent fan angle of the invention as the output jet 26 is deflected back-and-forth at high frequency by controlling the control jets 22 and 24 pressures.

Figure 2:
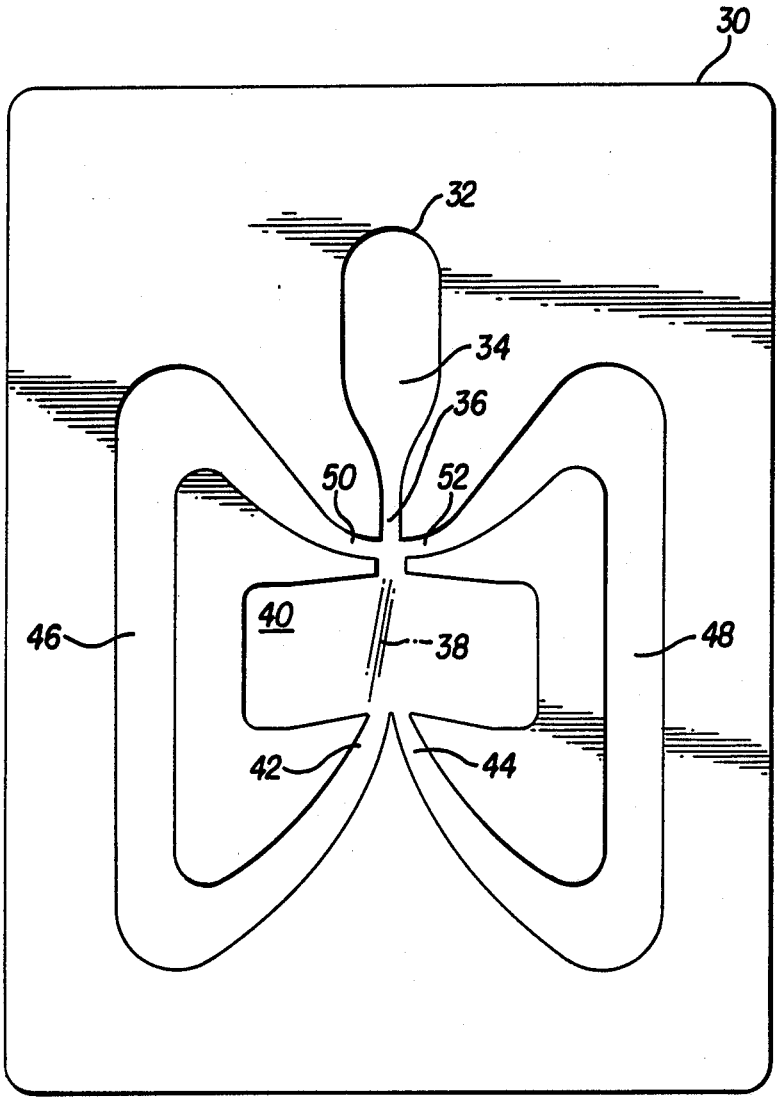
FIG. 2 illustrates a fluidic oscillator with feedback that provides pressure oscillation.

FIG. 2 illustrates a preferred embodiment of another component of the present invention, namely a planar fluidic amplifier 30. A pressure supply source 32 supplies fluid-to-fluid flow passage 34 and throat 36. These components produce a jet 38 which traverses interaction region 40. The jet 38 is directed toward two receivers 42 and 44 which split the flow of jet 38. From an initial disturbance, the flow, and consequently, the pressure in receivers 42 and 44 are larger in one receiver than the other receiver. For example, receiver 42 will be designated as the receiver that receives the larger flow. Because of the differences in flow into the receivers, differential pressure signals are created. These differential pressure signals are fed back through feedback passages 46 and 48 to the control ports 50 and 52, respectively. Control ports 50 and 52 are positioned one on either side of throat 36.

Again, for example, if receiver 42 receives greater flow than receiver 44, the pressure signal in feedback passage 46 will be greater than the pressure signal in feedback passage 48. As the pressure signals exit from the control ports 50 and 52, the larger pressure signal impacts jet 38 to a greater extent than the smaller signal. Thus, jet 38 is deflected away from the control port exerting the larger pressure toward the opposite control port. Thus, in this example, jet 38 is deflected away from control port 50 and toward control port 52. This deflection of jet 38 causes jet 38 to enter the other receiver 44 which previously received less of the flow. A differential pressure signal is again transmitted through the feedback passages 46 and 48 as previously described. However, in this instance, the flow in receiver 44 will be greater than the flow in receiver 42, so the pressure in feedback passage 48 will be greater than the pressure in feedback passage 46. As the larger pressure exits from control port 52, jet 38 is deflected toward control port 50. This deflection causes a greater amount of the flow of jet 38 to enter receiver 42. This process repeats to form an oscillatory pressure signal.

The oscillatory pressure signal generated by the fluidic oscillator 30 is a differential pressure signal that varies in a periodic fashion (e.g., sinusoidally). The frequency of the oscillatory pressure signal is determined by the time delays in the movement across the interaction region 40, through receivers 42 and 44, and back through feedback passages 46 and 48.

Figure 3:
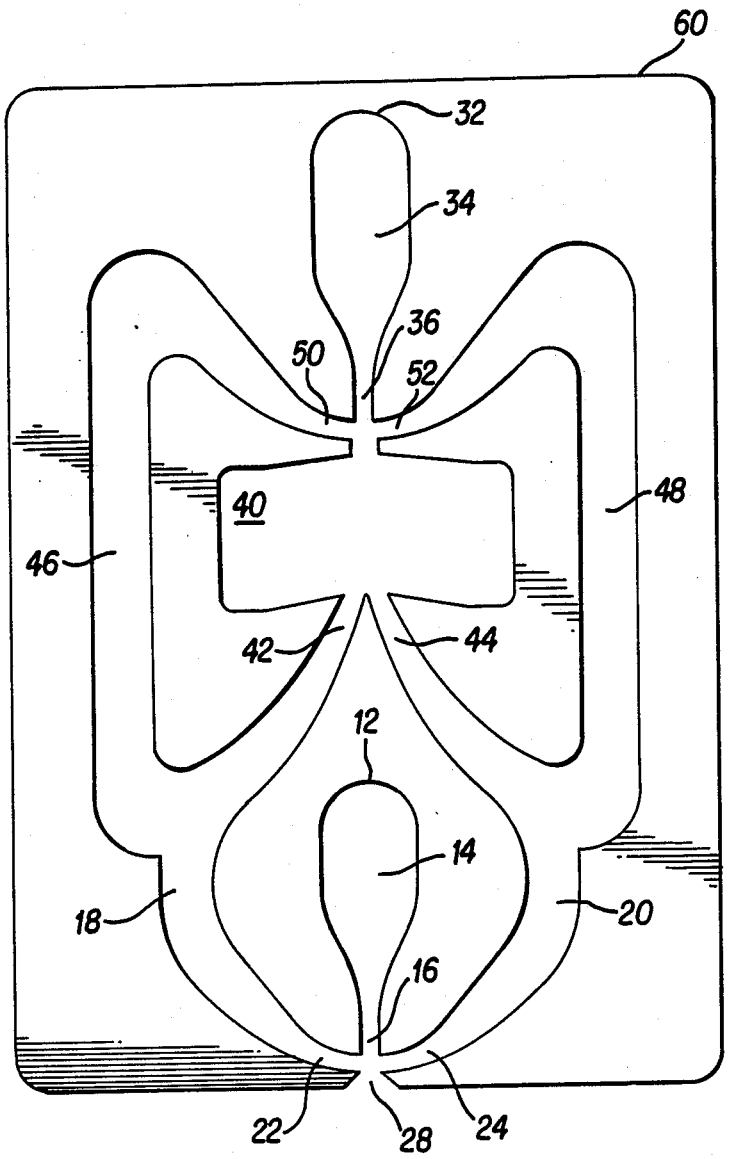
FIG. 3 illustrates the fluidic device that comprises the present invention, a fluidic oscillating nozzle.

Referring to FIG. 3, there is illustrated a fluidic circuit 60 that results from the interconnection of the deflected-jet fluidic nozzle 10 of FIG. 1 and the fluidic oscillator 30 of FIG. 2. By connecting the feedback passages 46 and 48 of the fluidic oscillator 30 to the control ports 18 and 20, respectively, of the deflected-jet fluidic nozzle 10, the oscillatory pressure signal of the fluidic oscillator 30 drives the power jet of output nozzle 28 in a sweeping pattern. The aforementioned fluidic devices can be interconnected in a variety of means such as: a solid planar part with indentations for the flow paths, a laminated overlay stackup, or other similar means. For purposes of explanation, a planar technique is illustrated in FIG. 3.

In operation, the oscillatory pressure signal generated in the receivers 42 and 44 of the fluidic oscillator 30 is split to provide feedback pressure required for oscillation of the fluidic oscillator 30 and the pressure required to deflect the output jet 26 in the deflected-jet fluidic nozzle 10. By proper staging and sizing, a balance of pressure and flow can be met that will permit oscillation of the fluidic oscillator 30 with sufficient pressure remaining to deflect the power jet of the deflected-jet fluidic nozzle 10.

The fluidic circuit 60 shown in FIG. 3 represents a two-stage fluidic amplifier circuit. In staging two fluidic devices, the staging parameters that affect the input impedances and the jet deflection gains include the ratio of the supply pressures at 12 and 32, the ratio of flow areas at the throats 16 and 36, as well as the dimensions of the control ports 50 and 52 and in control nozzles 22 and 24. Acceptable performance has been observed with a wide range of operational parameter values. A typical desirable set of parameters is a supply pressure at port 32 less than or equal to the supply pressure at port 12 and a flow area of throat 16 two to five times the flow area of throat 36. Variation of these staging parameters affect the quality of the oscillating jet in terms of its coherence and spread angle, $2\alpha$. The distance from throat 36 and receivers 42 and 44, as well as the length of feedback passages 46 and 48, determine the oscillating frequency for a given pressure at supply port 32. Additionally, the frequency varies as a function of supply pressure.

Figure 4:
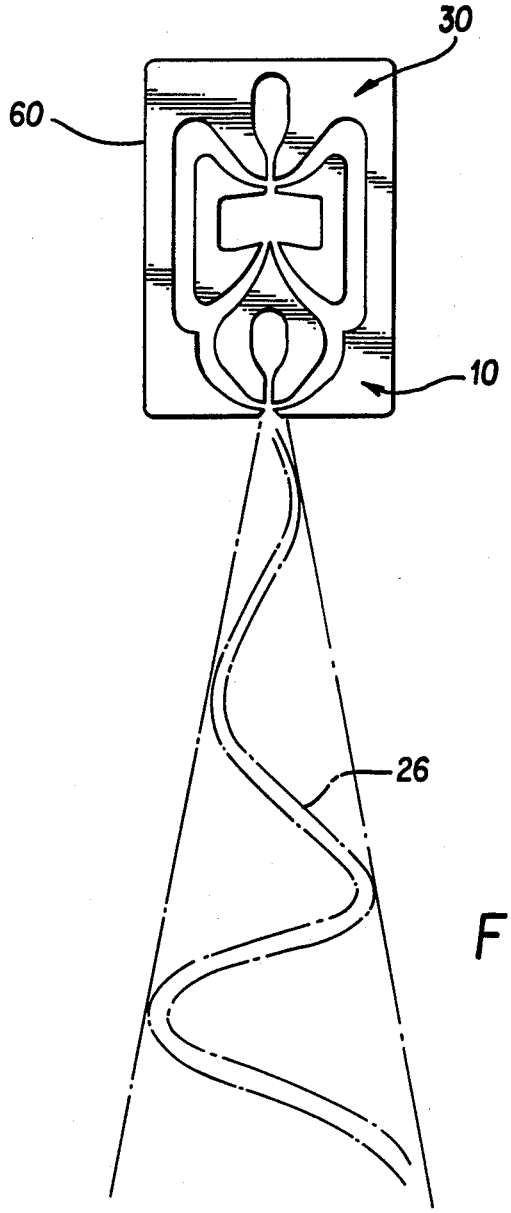
FIG. 4 illustrates the flow pattern of the oscillating jet as it issues from the fluidic oscillating nozzle.

The resulting flow pattern that issues from the combined fluidic circuit illustrated in FIG. 3 will have the pattern illustrated in FIG. 4. The output jet 26, being a coherent zero-degree jet, does not expand its flow area significantly during its path of flow. In the absence of an oscillatory pressure signal generated by the fluidic oscillator 30, the jet would travel a long distance in a tight pattern. As the oscillating pressure signal from the fluidic oscillator 30 is applied to the deflected-jet fluidic nozzle 10, the output jet 26 is deflected in a sweeping pattern. If the fluidic oscillator 30 produces a square-wave signal (such as generated by a bistable amplifier), then the output jet 26 will switch from full deflection to the left to full deflection to the right. This pattern will produce long dwell times and higher weighting on the extreme left and right edges of the impact pattern. If the signal from oscillator 30 is a sine wave (such as produced by a proportional amplifier), then the sweeping pattern will be as shown in FIG. 4. One optimum pattern is a trianglular wave such that the dwell time at the two extremes would be minimized and the fan pattern would produce an equal impact energy density pattern on the surface being cleaned.

In one embodiment of this invention, the pressure and flow in the interaction region 40 is relieved to ambient pressure by venting. Alternatively, by correctly matching the fluidic oscillator 30 with the deflected-jet nozzle 10, it is possible to operate the system without relieving the vent pressure in interaction region 40 and thereby avoid having additional flow from the device except through the output nozzle 26. Such an unvented system comprises a second embodiment of this invention.

The aforementioned matching of the fluidic oscillator 30 with the deflected-jet nozzle 10 can be accomplished by appropriate selection of the staging parameters. If the pressure ratio and the flow areas are selected such that the flows from the receivers 42 and 44 match the sum of the flows required for feedback to the control ports 50 and 52 and for deflection of the output jet 26 with sufficient gain to cause full deflection, then flow venting of the interaction area 40 to the ambient pressure will not be necessary. Alternatively, if the fluidic circuit 60 is operated with excess flow from receivers 42 and 44, the pressure in the interaction region 40 will be raised in unvented.

Figure 5:
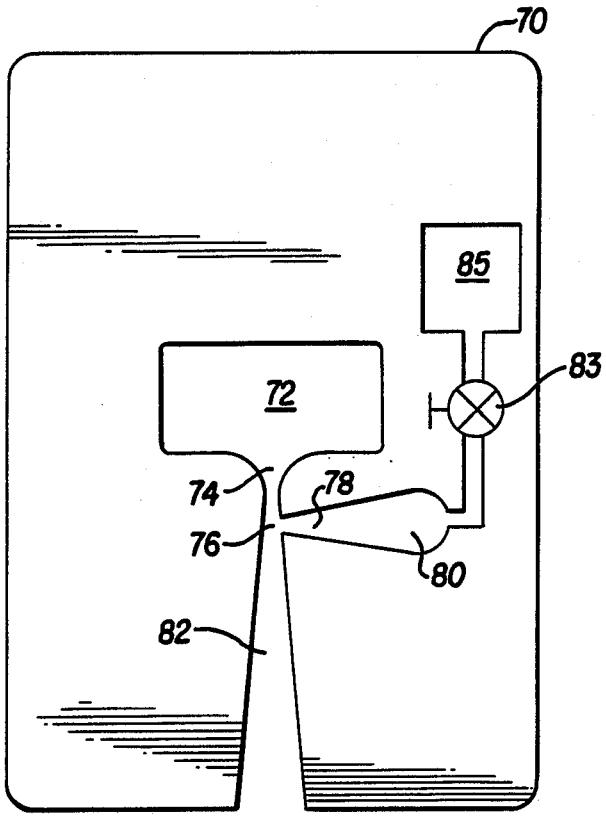
FIG. 5 illustrates the configuration of a venturi jet pump that may be used to create suction to inject fluids into the jet stream.

If the aforementioned venting is done through a converging-diverging nozzle such as a venturi jet pump, then a substantial vacuum signal can be generated. This vacuum signal can be used to draw soap or other chemicals into the vented stream by a suction effect and then joined with the power jet 26. One example of such a system is illustrated in FIG. 5 wherein a venturi jet pump 70 utilizes the return flow from the interaction region 40 of the fluidic oscillator 30 (not shown). This return flow passes through an interconnecting path to a plenum area 72. Plenum area 72 acts as a supply pressure to a converging section 74 and a diverging section 82 of a venturi. The lowest pressure in the flow occurs at a throat 76 which joins the two venturi sections 74 and 82. A suction inlet jet 78 is placed adjacent to throat 76 and communicates the sub-ambient pressure created by the venturi flow in sections 74 and 82 to a suction port 80. Soap or other chemicals stored in a container 85 are preferably mixed with the flow stream in the venturi jet pump 70 for application to the surface being cleaned.

One advantage of the introduction of soap or chemicals at a venturi suction port (such as port 80) on the nozzle is that the soap does not have to pass through the pump. This technique is significant for two reasons. First, the chemicals being used could be harmful to the pump materials and parts such that the life of the pump would be reduced. Second, the introduction of chemicals at the inlet of the pump requires a sub-ambient pressure that increases the possibility of cavitation at the pump inlet. Cavitation is an undesirable phenomenon due to the noise generated and the reduction in pump life. Therefore, one additional feature of this invention is that the chemical suction effect at the nozzle eliminates cavitation in the pump. Additionally, the introduction of soap or chemicals may be controlled by a valve means in the manifold either placed at the inlet to the venturi pump (not shown) or between the suction port 80 and container 85. The later embodiment is illustrated in FIG. 5.

Figure 6:
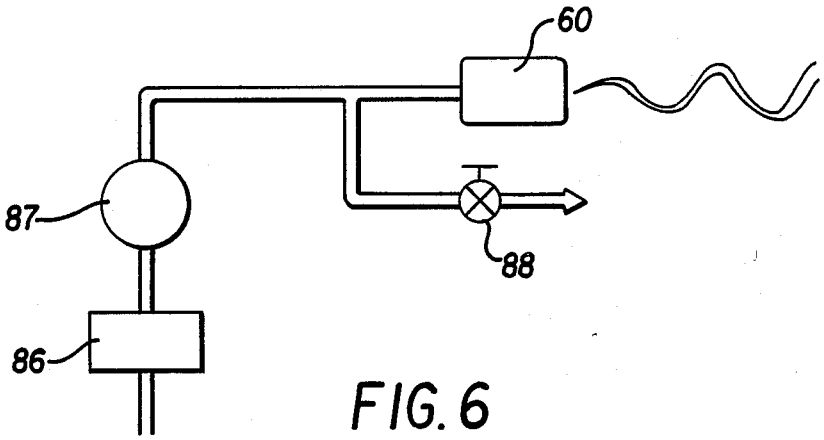
FIG. 6 illustrates a schematic of an embodiment of the present invention with soap or chemical injector means positioned upstream of the main mechanical pump.

If the chemicals are introduced by injector means 86 upstream of the main mechanical pump 87 as shown in FIG. 6, it is usually necessary to lower the discharge pressure of the pump outlet so that the maximum flow rate is realized through the pump. Thus, sub-ambient pressure will provide a suction of the soap or chemicals at the pump inlet. For this configuration of a pumping system, bypass valve means 88 can be added to the subject invention in order to reduce the downstream pressure. The bypass valve means 88 connects the pump outlet pressure to ambient pressure. This feature may be activated by a gate valve in the manifold of the invention.

The invention may be embodied in other specific forms without departing from the spirit or essential characteristics thereof. The embodiments described above are therefore to be considered in all respects as illustrative and not restrictive, the scope of the invention being indicated by the hereafter appended claims rather than by the foregoing description, and all changes which come within the meaning and range of equivalency of the claims are therefore intended to be embraced therein.

What is claimed is:

1. A fluidic oscillating nozzle comprising:

a supply port operatively connected to a first fluid flow passage converging to a first throat portion;

first nozzle means for generating a zero-degree jet of fluid, said first nozzle means located downstream of said first fluid flow passage and said first throat portion;

control means including a first control nozzle for projecting a first jet of fluid substantially transverse to and substantially in the same plane as the flow of said zero-degree jet and a second control nozzle for projecting a second jet of fluid substantially transverse to and substantially in the same plane as the flow of said zero-degree jet, said first and second control nozzles positioned one on either side of said first throat portion; and a fluid oscillator connected to said control means, said fluidic oscillator comprising:

a pressure source operatively connected to a second fluid flow passage converging to a second throat portion;

second nozzle means for projecting a jet of fluid, said second nozzle means located downstream of said second fluid flow passage and said second throat portion;

an interaction region including an inlet opening and an outlet opening; and first and second feedback passages originating at receiver means and terminating at first and second control ports, said receivers connected to said interaction region outlet opening, and said first and second control ports connected to said second fluid flow passage on either side of said first throat portion and located upstream of said interaction region inlet opening.

2. A fluidic oscillating nozzle as recited in claim 1, wherein said interaction region contains means for communicating pressure from said interaction region to the surrounding atmosphere.

3. A fluidic oscillating nozzle as recited in claim 1, wherein said interaction region is unvented to the surrounding atmosphere.

4. A fluidic oscillating nozzle as recited in claim 1, wherein said interaction region is operatively connected to a venturi jet pump, said venturi jet pump comprising a plenum area to receive fluid flow from said interaction region, said plenum area operatively connected to a fluid flow chamber consisting of a converging-diverging venturi, and a suction inlet jet positioned mediate said converging venturi and said diverging sections of the venturi.

5. A fluidic oscillating nozzle as recited in claim 4, further comprising means for introducing soap, chemicals, or other fluids at said suction inlet jet.

6. A fluidic oscillating nozzle as recited in claim 5, further comprising a suction port and valve means for controlling flow from said suction port to said diverging section of the venturi.

7. A fluidic oscillating nozzle as recited in claim 1, further comprising a main mechanical pump and injector means for introducing soap, chemicals, or other fluids upstream of an inlet to said main mechanical pump.

8. A fluidic oscillating nozzle as recited in claim 7, further comprising bypass valve means for communicating pressure at outlet to said main mechanical pump to the surrounding atmosphere.

* * * * *